United States Patent [19]

Moore

[11] 4,339,414

[45] Jul. 13, 1982

[54] METHOD FOR LOADING OF URANYL ION COMPLEXES ON ION EXCHANGE RESIN

[75] Inventor: Thomas F. Moore, Richardson, Tex.

[73] Assignee: Atlantic Richfield Company, Los Angeles, Calif.

[21] Appl. No.: 938,289

[22] Filed: Aug. 30, 1978

[51] Int. Cl.[3] ..... B01D 15/04

[52] U.S. Cl. ..... 423/7; 210/682

[58] Field of Search ..... 210/37 B, 38 C, 682; 423/7, 17

[56] References Cited

U.S. PATENT DOCUMENTS

| | | | |
|---|---|---|---|
| 2,780,514 | 2/1957 | Lutz | 210/37 B |
| 2,841,468 | 7/1958 | Wilson | 423/7 |
| 2,982,605 | 5/1961 | Mouret et al. | 423/7 |
| 2,992,887 | 7/1961 | Thunaes et al. | 423/17 |

*Primary Examiner*—Ivars C. Cintins

*Attorney, Agent, or Firm*—R. W. MacDonald

[57] ABSTRACT

The present invention relates to an improved method for removing uranyl ion complexes from a pregnant alkaline leach solution. More particularly, it relates to an improved method for removing uranyl ion carbonato complexes from a pregnant alkaline leach solution with an ion exchange resin which comprises adding carbon dioxide to the solution prior to removing the uranyl ion complexes.

5 Claims, No Drawings

METHOD FOR LOADING OF URANYL ION COMPLEXES ON ION EXCHANGE RESIN

It is well known that uranium in the form of uranyl ions and their complexes may be recovered from pregnant leach solutions by contacting such a solution with an ion exchange resin.

It is also known that the loading of an ion exchange resin is affected by many variables, such as concentrations of competing ions in the solution which contact the resin. The relative concentrations of uranium, carbonate and bicarbonate in pregnant alkaline leach solutions affect the loading capability of an ion exchange resin.

It has been found that the loading of uranium from a pregnant alkaline leach solution of an ion exchange resin is not an easy task. Achievement of satisfactory loading has been a hit or miss proposition that has been a costly and time consuming problem which has heretofore remained unsolved.

It has also been found that in a mature field in situ leaching operation, especially one in which oxygen breakthrough has occurred in some of the producing patterns, evolution of oxygen in the field gathering facilities carries with it some of the carbon dioxide present therein. This decrease of carbon dioxide in the pregnant solution causes an increase in the degree of $CaCO_3$ saturation in the pregnant solution thereby causing a decrease in the loading of uranyl ion complexes on the ion exchange resin. Therefore, there is needed a method whereby uranium from a pregnant alkaline leach solution can be loaded on ion exchange resins with reliable and satisfactory repeatable results.

Therefore, it is an object of the present invention to provide an improved method for loading of uranium on an ion exchange resin.

A further object of the present invention is to provide an improved method for the loading of uranium from a pregnant alkaline leach solution on an ion exchange resin.

It is an additional objective of the present invention to provide an improved method for the loading of uranium in the form of uranyl ion complexes on an ion exchange resin from a pregnant alkaline leach solution saturated with $CaCO_3$ which prevents the achievement of maximum loading.

Other objects, aspects and the several advantages of the present invention will become apparent upon a further reading of this disclosure and the appended claims.

It has now been found that the objects of the present invention can be attained, in a method for removing uranyl ion complexes from a pregnant alkaline leach solution with an ion exchange resin via contacting the resin with the solution, by adding carbon dioxide to said solution prior to the removal of the uranyl ion complexes to achieve maximum loading thereof. Suitably, the solution containing carbon dioxide has a pH from 5.5 to about 7.5.

In the operation of the present invention, the degree of $CaCO_3$ saturation in the pregnant leach solution is controlled by the injection of carbon dioxide into the solution. Carbon dioxide decreases the pH and $CaCO_3$ saturation of the solution. High levels of $CaCO_3$ saturation can reduce the loading of uranyl ion complexes on the resin to near zero.

It has been discovered that as the degree of $CaCO_3$ saturation in the pregnant solution increases from zero to more than 150 percent, the loading of uranyl ion complexes on an ion exchange resin can decline from about 7 pounds $U_3O_8$ per cubic foot to about one pound per cubic foot and less. This loss of resin loading occurs whether the higher level of $CaCO_3$ saturation results from increased calcium ion concentration or decreased hydrogen ion concentration. A change in the calcium ion concentration of the leach solution affects the resin loading more than a change in the hydrogen ion concentration.

In an alkaline leach of a subterranean formation for uranium, the pH range of the pregnant solution is normally from about 6 to about 9, especially when an alkaline leach solution of ammonium or sodium carbonate and/or bicarbonate is utilized. The pregnant leach solution is nearly saturated in calcium carbonate. In addition, $CO_2$ evolution at field gathering tanks due to pressure reduction and oxygen evolution further increases the degree of calcium carbonate saturation. In this situation, the increase of calcium carbonate saturation either exceedingly slows down the loading of $U_3O_8$ on the resin or completely stops it.

The operation of the present invention can be illustrated by considering the following test runs. The $CO_2$ runs were made with undiluted pregnant solution equilibrated with pure $CO_2$ at one atmosphere pressure.

The following table gives the compositions of fluids in field loading tests. The runs were made with actual pregnant solutions from an ore zone containing a high degree of carbonate minerals. Test ion exchange columns contained 400 ml. of Amberlite IRA-430 resin.

COMPOSITIONS* OF FLUIDS IN FIELD LOADING TESTS

| Test # | $U_3O_8$ | Cl | $SO_4$ | $HCO_3$ | pH | Ca | $P^{+++}$ $CO_2$ | Bed Vol.++ | Flow Rate*** | 5 ppm** Loading | R+ | Remarks |
|---|---|---|---|---|---|---|---|---|---|---|---|---|
| 1 | 37 | 890 | 1860 | 460 | 6.61 | 660 | — | 400 | 87.6 | 1.19 | 2.06 | Standard col., field preg. |
| 2 | 34 | 860 | 1780 | 467 | 6.67 | 330 | .095 | 400 | 90.5 | >2.65 | 1.99 | 50% dilution of $Ca^{++}$, etc. |
| 3 | 29 | 920 | 1920 | 430 | 6.55 | 690 | — | 400 | 87.0 | 1.30 | 2.07 | Standard, col. |
| 4 | 28 | 920 | 1890 | 425 | 6.65 | 377 | .095 | 400 | 90.3 | >4.00 | 1.99 | 50% dilution of $Ca^{++}$, etc. |
| 5 | 29 | 920 | 1920 | 430 | 6.00 | 690 | ~1.0 | 400 | 104.2 | 3.11 | 1.73 | $CO_2$ injection, low pH |
| 6 | 31.5 | 930 | 1980 | 430 | 6.52 | 680 | — | 400 | 92.7 | 1.36 | 1.94 | Standard column |
| 7 | 30.3 | 925 | 1940 | 430 | 6.52 | 300 | .095 | 400 | 94.3 | 3.81 | 1.90 | 50% dilution of $Ca^{++}$ only |

-continued

COMPOSITIONS* OF FLUIDS IN FIELD LOADING TESTS

| Test # | $U_3O_8$ | Cl | $SO_4$ | $HCO_3$ | pH | Ca | P+++ $CO_2$ | Bed Vol.++ | Flow Rate*** | 5 ppm** Loading | R+ | Remarks |
|---|---|---|---|---|---|---|---|---|---|---|---|---|
| 8 | 31.5 | 930 | 1980 | 430 | 6.07 | 680 | ~1.0 | 400 | 106.4 | 3.35 | 1.69 | $CO_2$ injection, low pH |

*All concentrations are in ppm
+Residence time (minutes): calculated assuming porosity equal to 0.45
**Loadings in # $U_3O_8/ft^3$ wet settled resin
++Milliliters of wet settled resin bed
***Milliliters/minute
+++psia Comparison of run #5 with runs #1 and 3; run #8 with run #6 clearly shows the increased loading achieved by the practice of the present invention.

Therefore, by properly adjusting the pH of the leach solution, thereby controlling the degree of $CaCO_3$ saturation in solution, improved loading for a specific leach solution composition can be attained.

Having thus described my invention, I claim:

1. An improved method for removing uranyl ion complexes from a pregnant leach solution containing same with an ion exchange resin, wherein the improvement comprises adding carbon dioxide to said solution prior to said removal.

2. The method of claim 1 wherein said solution is saturated with $CaCO_3$.

3. The method of claim 2 wherein the degree of $CaCO_3$ saturation in said solution is 25%.

4. The method of claim 2 wherein the degree of $CaCO_3$ saturation in said solution is 150%.

5. The method of claim 1 wherein said solution containing said carbon dioxide has a pH from 5.5 to about 7.5.

* * * * *